US006298946B1

(12) United States Patent
Yemini et al.

(10) Patent No.: US 6,298,946 B1
(45) Date of Patent: Oct. 9, 2001

(54) HEIGHT AND WORKING WIDTH ADJUSTABLE SAWHORSE

(75) Inventors: Zvi Yemini; Eran Noiman, both of Tel Aviv (IL)

(73) Assignee: Zag Industries Ltd., Rosh Ha'Ayin (IL)

( * ) Notice: Subject to any disclaimer, the term of this patent is extended or adjusted under 35 U.S.C. 154(b) by 0 days.

(21) Appl. No.: 09/372,669

(22) Filed: Aug. 12, 1999

(30) Foreign Application Priority Data

Aug. 14, 1998 (IL) ..... 125793

(51) Int. Cl.[7] ..... E04G 1/34
(52) U.S. Cl. ..... 182/153; 182/182.1; 182/183.1
(58) Field of Search ..... 182/181.1, 182.1, 182/182.2, 182.3, 183.1, 186.6, 153, 225, 226, 227

(56) References Cited

U.S. PATENT DOCUMENTS

| | | | | |
|---|---|---|---|---|
| 376,867 | * | 1/1888 | Goodrich | 182/153 |
| 850,351 | * | 4/1907 | Crum | 182/153 |
| 881,556 | * | 3/1908 | Dehler | 182/153 |
| 1,633,000 | * | 6/1927 | Culver | 182/183.1 |
| 2,676,659 | * | 4/1954 | Emmer . | |
| 2,829,012 | * | 4/1958 | Snyder | 182/225 |
| 2,904,087 | * | 9/1959 | Walthall . | |
| 2,965,305 | * | 12/1960 | Glazer | 182/183.1 |
| 3,612,426 | * | 10/1971 | Germock | 248/51 |
| 3,999,628 | * | 12/1976 | Parson | 182/129 |
| 4,401,142 | * | 8/1983 | Linossi . | |
| 4,494,627 | * | 1/1985 | Avent | 182/181.1 |
| 4,502,518 | * | 3/1985 | Lewin . | |
| 4,951,782 | * | 8/1990 | Hanson | 182/153 |
| 5,522,128 | * | 6/1996 | Sauve . | |
| 5,538,102 | | 7/1996 | Yemini | 182/225 |
| 5,560,448 | * | 10/1996 | Yemini | 182/225 |
| 5,865,269 | * | 2/1999 | Eskesen | 182/182.1 |
| 5,868,185 | * | 2/1999 | Poling . | |
| 5,904,225 | * | 5/1999 | Patros | 182/183.1 |
| 6,070,696 | * | 6/2000 | Chubb | 182/182.1 |
| 6,164,413 | * | 12/2000 | Sagol | 187/153 |

FOREIGN PATENT DOCUMENTS

| | | | | |
|---|---|---|---|---|
| 672990 | * | 3/1966 | (BE) | 182/182.1 |
| 2291329 | * | 6/1976 | (FR) | 182/182.1 |
| 372618 | * | 5/1932 | (GB) | 182/153 |
| 2042326 | * | 9/1980 | (GB) | 248/51 |

* cited by examiner

*Primary Examiner*—Alvin Chin-Shue
(74) *Attorney, Agent, or Firm*—Pillsbury Winthrop LLP

(57) ABSTRACT

A sawhorse comprises a base assembly including a first base member and a second base member. The first base member has a first top end, and the second base member has a second top end. The second base member is pivotally connected at the second top end to the first top end of the first base member. The first and second bases members are pivotally movable between a folded storage position and an extended operative position. A vertically extendible top member is constructed and arranged to be adjustably mounted in varying vertical positions with respect to the base assembly. The extendible top member includes an elongated, laterally extending top element constructed and arranged to support a workpiece, and a pair of elongated extension elements that are constructed and arranged to be adjustably engaged at varying vertical positions relative to the base assembly so as to adjust the height of the top element.

17 Claims, 13 Drawing Sheets

HEIGHT AND WORKING WIDTH ADJUSTABLE SAWHORSE

BACKGROUND OF THE INVENTION

This application claims priority from Israeli Patent Application No. 125793, filed Aug. 14, 1998, the contents of which are incorporated herein by reference.

FIELD OF THE INVENTION

The present invention relates to a sawhorse and, more particularly, to a height and/or working width adjustable sawhorse. The present invention further relates to a sawhorse having its base members modified to render them stronger when operably deployed, yet avoid occupying extra space when collapsed (folded, closed) together.

A sawhorse is a movable frame or trestle for supporting wood while it is being sawed or for supporting plates to provide working spaces. A sawhorse typically includes two base members hingedly connected at the tops thereof and a locking mechanism which defines the working spread at their bottom.

Traditionally sawhorses were made of wood or metal, however, following the technological progress of the plastic industry, sawhorses are nowadays also available from plastic materials.

For whatever purpose it is employed, it is advantageous for a sawhorse to be adjustable both in height and in working width. Height adjustability is advantageous because it enables users of different heights to adjust the height of the sawhorse to be most comfortable for them. Working width adjustability is advantageous as it enables working width versatility.

Prior art sawhorses are known which are height adjustable. Such device have extendible/retractable extensions housed by the lower ends of their base members. Such devices suffer a limitation because the process of height adjustability is highly demanding. It requires a user to independently adjust four individual extensions in each sawhorse. Adjustment of each of the four extension calls for bending over (or turning the sawhorse upside down), pulling out the extension and securing it in its new extended or retracted position. For stability, measures should be taken by the user to ensure that all extensions are extended to a similar extent.

Although there is a long felt need for working width adjustable sawhorses, the prior art fails altogether to teach working width adjustable sawhorses.

There is thus a widely recognized need for, and it would be highly advantageous to have, a height and/or working width adjustable sawhorse which enjoys the above advantages yet is devoid of the above limitations.

It would also be highly advantageous to have a sawhorse having its base members modified to render them stronger when operably deployed, yet avoid occupying extra space when collapsed together.

SUMMARY OF THE INVENTION

It is an object of the present invention to provide a height adjustable sawhorse, in which height adjustability is embedded at a top portion thereof.

It is another object of the present invention to provide a working width adjustable sawhorse.

It is yet another object of the present invention to provide a sawhorse having its base members modified to render them stronger when operably deployed, yet avoid occupying extra space when collapsed together.

It is yet another object of the present invention to provide a sawhorse fulfilling any complete or partial combination of the above objects.

Thus, according to one aspect of the present invention there is provided a sawhorse comprises a base assembly including a first base member and a second base member. The first base member has a first top end, and the second base member has a second top end. The second base member is pivotally connected at the second top end to the first top end of the first base member. The first and second bases members are pivotally movable between a folded storage position and an extended operative position. A vertically extendible top member is constructed and arranged to be adjustably mounted in varying vertical positions with respect to the base assembly. The extendible top member includes an elongated, laterally extending top element constructed and arranged to support a workpiece, and a pair of elongated extension elements that are constructed and arranged to be adjustably engaged at varying vertical positions relative to the base assembly so as to adjust the height of the top element.

According to another aspect of the present invention there is provided a sawhorse comprising (a) an extendible top member featuring a top element and at least one extension element connected to or integrally formed with the top element; (b) a first base member having a first top end, the first base member being designed for accepting at least one extension element of the top member; and (c) a second base member having a second top end, the second base member being hingedly connected at the second top end to the first top end of the first base member.

According to yet another aspect of the present invention there is provided a sawhorse comprising (a) an extendible top member featuring a top element and at least one extension element connected to or integrally formed with the top element; (b) a first base member having a first top end; (c) a second base member having a second top end; and (d) an intermediate member being designed for accepting at least one extension element of the top member, each of the first and second base members being hingedly connected at the first and second top ends thereof to different sides of the intermediate member.

According to still another aspect of the present invention there is provided a sawhorse comprising (a) a first base member having a first top end; (b) a second base member having a second top end, the second base member being hingedly connected at the second top end to the first top end of the first base member, and (c) an extendible top member being integrally formed with or connected to at least one of the first and second base members.

According to a further aspect of the present invention there is provided a sawhorse comprising (a) a first base member having a first top end; and (b) a second base member having a second top end, the second base member being hingedly connected at the second top end to the first top end of the first base member; wherein the first base member has a closed cross section and further wherein the second base member has an open cross section, the closed and open cross sections are selected such that when the sawhorse is folded by bringing the first and second base members together, the second base member overlaps and houses the first base member.

According to further features in preferred embodiments of the invention described below, the sawhorse further comprises a spread limiting mechanism for limiting a spread of bottom ends of the first and second base members. According to still further features in the described preferred embodiments the spread limiting mechanism is shaped as a shelf, the shelf is hingedly connected to one of the first and second base members and locks the other when deployed.

According to still further features in the described preferred embodiments the sawhorse further comprises a securing mechanism for securing at least one extension element of the top member at a desired extended position.

According to still further features in the described preferred embodiments the securing mechanism is effected by the second top end of the second base member.

According to still further features in the described preferred embodiments the securing mechanism is effected by the first and second top ends of the first and second base members.

According to still further features in the described preferred embodiments the sawhorse further comprises at least one hook being connected to or integrally formed with at least one of the first and second base members.

According to still further features in the described preferred embodiments the sawhorse further comprises a socket holder being connected to or integrally formed with at least one of the first and second base members.

According to still further features in the described preferred embodiments the sawhorse further comprises a cable holder being connected to or integrally formed with at least one of the first and second base members.

The invention further provides a sawhorse that includes a base assembly and a workpiece storage assembly. The base assembly is movable between a folded storage position and an open operative position in supported relation on a horizontal surface. The workpiece support assembly is mounted on the base assembly for vertical movement in opposite directions with respect to the base assembly through a range of vertical positions. The workpiece storage assembly has a workpiece supporting surface which faces upwardly when the base assembly is in its operative position. The base assembly and the workpiece support assembly having cooperating structure operable when the base assembly is in its storage position to enable the workpiece support assembly to be manually moved in opposite directions into a selected position of movement with respect to the base assembly. The cooperating structure is operable in response to the movement of the base assembly from the storage position thereof with the workpiece support assembly in a selected position into the operative position thereof to prevent the workpiece support assembly from downward movement out of the selected position so as to position the workpiece support surface a selected distance above the horizontal surface on which the base assembly is supported in the operative position thereof.

The present invention successfully addresses the shortcomings of the presently known configurations by providing a height and/or working width adjustable sawhorse preferably having its base members modified to render them stronger when operably deployed, yet avoid occupying extra space when collapsed together.

BRIEF DESCRIPTION OF THE DRAWINGS

The invention herein described, by way of example only, with reference to the accompanying drawings, wherein.

DESCRIPTION OF THE PREFERRED EMBODIMENTS

Figure 1:
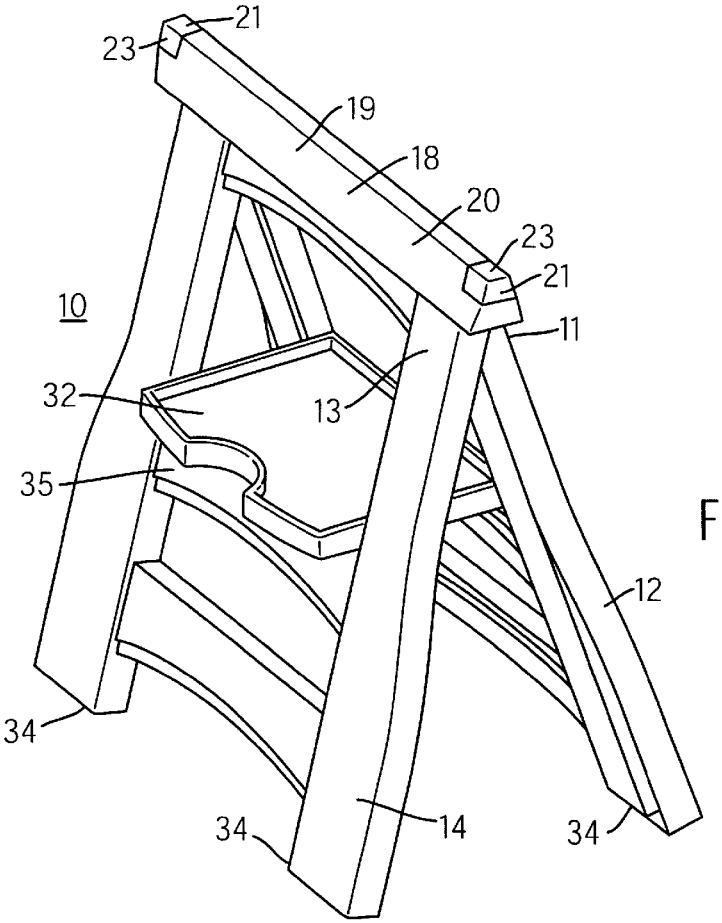
FIG. 1 is a perspective view of a height/working width adjustable sawhorse according to a first embodiment of the present invention shown in a height and working width retracted positions.

The present invention is of a height and/or working width adjustable sawhorse which can be height and/or working width adjusted for different users and/or applications. The present invention is further of a sawhorse having its base members modified to render them stronger when operably deployed, yet avoid occupying extra space when collapsed (folded, closed) together.

The principles and operation of a sawhorse according to the present invention may be better understood with reference to the drawings and accompanying descriptions.

Before explaining at least one embodiment of the invention in detail, it is to be understood that the invention is not limited in its application to the details of construction and the arrangement of the components set forth in the following description or illustrated in the drawings. The invention is capable of other embodiments or of being practiced or carried out in various ways. Also, it is to be understood that the phraseology and terminology employed herein is for the purpose of description and should not be regarded as limiting.

Referring now to the drawings, FIGS. 1–6 illustrate several embodiments of a sawhorse according to the present invention, which is referred to hereinbelow as sawhorse 10.

The sawhorse 10 includes a first base member 12 having a first top end 11. The sawhorse 10 further includes a second base member 14 having a second top end 13. The second base member 14 is hingedly connected directly (FIGS. 1–5) or indirectly (FIG. 6) at the second top end 13 thereof to the first top end 11 of the first base member 12. The sawhorse 10 further includes an extendible top member or workpiece support assembly 18. The top member 18 features a top element 20 and at least one extension element 22 (two are shown) connected to or integrally formed with top element 20. Sawhorse 10 further includes an elongated leg arrangement 24 directly (FIGS. 1–5) or indirectly (FIG. 6) associated with at least one of first 12 and second 14 base members. The leg arrangement 24 serves for accepting the extension elements 22 of the top member 18.

As shown in FIGS. 1–5, according to a preferred embodiment of the present invention, the sawhorse 10 includes an extendible top member 18 featuring a top element 20 and at least one (two are shown) extension elements 22 connected to or integrally formed with the top element 20. The sawhorse 10 according to this embodiment further includes a first base member 12 having a first top end 11. According to this embodiment of the present invention, the first base member 12 is designed for accepting the extension elements 22 of the top member 18 and therefore serves as arrangement 24. To this end, at least two portions of the first base member 12 are hollowed and have openings for accepting the elements 22. The sawhorse 10 according to this embodiment of the present invention further includes a second base member 14 having a second top end 13. The second base member 14 is hingedly connected via a hinge 16 (FIG. 5) at the second top end 13 thereof to the first top end 11 of the first base member 12.

As shown in PIG. 6, according to another preferred embodiment of the present invention, the sawhorse 10 includes an extendible top member 18 featuring a top element 20 and at least one (two are shown) extension element 22 connected to or integrally formed with the top element 20. The sawhorse 10 according to this embodiment further includes a first base member 12 having a first top end 11 and a second base member 14 having a second top end 13. The sawhorse 10 according to this embodiment further includes an intermediate member 30 designed for accepting the extension elements 22 of the top member 18. According to this embodiment of the present invention, the intermediate member 30 serves as arrangement 24. In this case, each of the first 12 and the second 14 base members is hingedly connected at their first 11 and second 13 top ends, respectively, to different sides of the intermediate member 30.

As shown in FIGS. 1–4, according to another feature of a preferred embodiment of the present invention, the sawhorse 10 includes a first base member 12 having a first top end 11 and a second base member 14 having a second top end 13. The second base member 14 is hingedly connected at the second top end 13 thereof to the first top end 11 of the first base member 12. The sawhorse 10 according to this embodiment of the present invention further includes an extendible top member 18 which is integrally formed with or connected to at least one of the first 12 and second 14 base members. The top member 18 in this case includes a central section 19 having at least the end portions thereof hollowed. As shown in FIGS. 1–4, 17, 18*a* and 18*b*, the top member 18 is designed to translatably accommodate left and right translating arms 21. In one embodiment, both the left and right translating arms or arm members extend horizontally when one of the translating arms is pulled out. An internal halting mechanism is preferably provided to ensure that the arms 21 cannot be fully removed from their engagement in the central section 19. Such halting mechanisms are well known in the art and do not require further description herein. An external halting mechanism, in the form of caps 23 can be employed to prevent the arms 21 from disappearing within central element 19.

As shown in FIGS. 1–4, according to another feature of a preferred embodiment of the present invention, the sawhorse 10 includes a first base member 12 having a first top end 11 and a second base member 14 having a second top end 13. The second base member 14 is hingedly connected at the second top end 13 thereof to the first top end 11 of the first base member 12. The first base member 12 has a closed cross section (e.g., square cross section), whereas second base member 12 has an open cross section (e.g., U-shaped cross section). The closed and open cross sections are selected such that when the sawhorse 10 is folded (collapsed) by bringing the first 12 and second 14 base members together, the second base member 14 overlaps and houses the first base member 11 in nested relation to one another. As a result, twice as thick and strong base members can be employed, yet when folded they occupy a space similar to narrow prior art base members.

Figure 6:
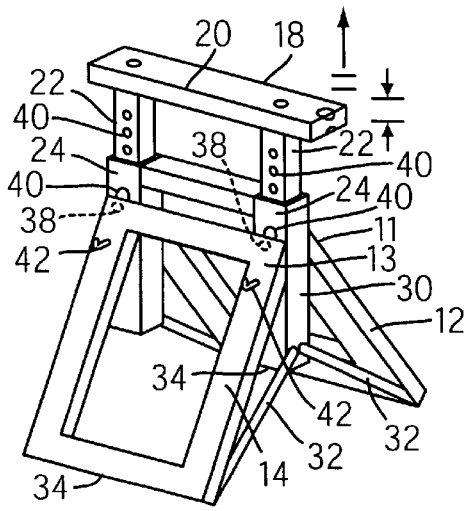
FIG. 6 is a perspective view of the height/working width adjustable sawhorse according to a second embodiment of the present invention in a height extended and working width retracted positions.

A similar configuration applies to the embodiment shown in FIG. 6. In this case, the first 12 and second 14 base members each have an open cross section, whereas the intermediate member 30 has a closed cross section. The closed and open cross sections are selected such that when the sawhorse 10 is folded by bringing the first 12 and second 14 base members together with the intermediate member 30, the first 12 and second 14 base members overlap and house the intermediate member 30.

It will be appreciated by one of ordinarily skill in the art, and it is to a great extent shown in the drawings, that various embodiments of the sawhorse according to the present invention can be provided together. Thus, FIGS. 1–4, for example, provide a combination of height adjustability, working width adjustability and base members modification for extra strength and stability upon deployment. According to a feature of a preferred embodiment of the present invention, the sawhorse 10 further includes a spread limiting mechanism 32 which serves for limiting a spread of bottom ends 34 of the first 12 and second 14 base members. As shown in FIGS. 1–4, the spread limiting mechanism 32 is shaped as a shelf and is hingedly connected, via a hinge 33, to the first base member 12, and is constructed to either lock onto the other base member 14 or to hook onto an upper cross-bar 35 of the second base member 14 when deployed. In the configuration of FIG. 6, however, the spread limiting mechanism 32 connects between the base members 12 and 14 and the intermediate member 30. Another configuration is shown in FIGS. 7–11, where the spread limiting mechanism 32 folds in half when the sawhorse is folded.

According to another feature of a preferred embodiment of the present invention, the sawhorse 10 further includes a securing mechanism 36. The securing mechanism 36 serves for securing the extension elements 22 of the top member 18 at a desired extended position. In the configuration shown in FIGS. 1–5 the securing mechanism 36 is effected by the second top end 13 of the second base member. To this end, as best seen in FIG. 5, at least a portion 15 of the second top end 13 is enlarged, and extensions 22 are formed with receptive regions (e.g., grooves) 39 designed for accepting the enlarged portions 15. In the configuration of FIG. 6, the securing mechanism 36 is effected by the first 11 and second 13 top ends of the first 12 and second 14 base members, respectively, which include, for example, pins 38 designed to engage holes 40 formed in the extensions 22, and thereby lock or secure the top member 18 at a desired height. In both cases, extending or retracting the top member 18 is effected when the base members 12 and 14 are collapsed. Thereafter, when the base members 12 and 14 are spread, securing is effected.

As shown in FIGS. 5 and 6, according to yet another feature of a preferred embodiment of the present invention, the sawhorse 10 further includes at least one hook 42, connected to or integrally formed with at least one of the first 12 and second 14 base members. The hooks 42 may have many different functions, such as, but not limited to, hanging items (e.g., working tools) thereon, so as to have the hanging items readily accessible to a user. The hooks 42 are preferably removable.

As specifically shown in FIGS. 2, 12, 15, and 16, according to still another feature of a preferred embodiment of the present invention, the sawhorse 10 further includes a socket holder 44 connected to or integrally formed with at least one of the first 12 and second 14 base members. The socket holder 44, which is connectable to an electrical source via a single electrical cord, is designed to replace a plurality of extension electrical cords, which are often required to operate a plurality of electric working tools, by a single cord.

As further shown in FIGS. 2, 10, 13, and 14, according to yet another feature of a preferred embodiment of the present invention, the sawhorse 10 further includes a cable holder 46 connected to or integrally formed with at least one of the first 12 and second 14 base members. The holder 46 serves to hold, for example, an electric extension cord.

Figure 2:
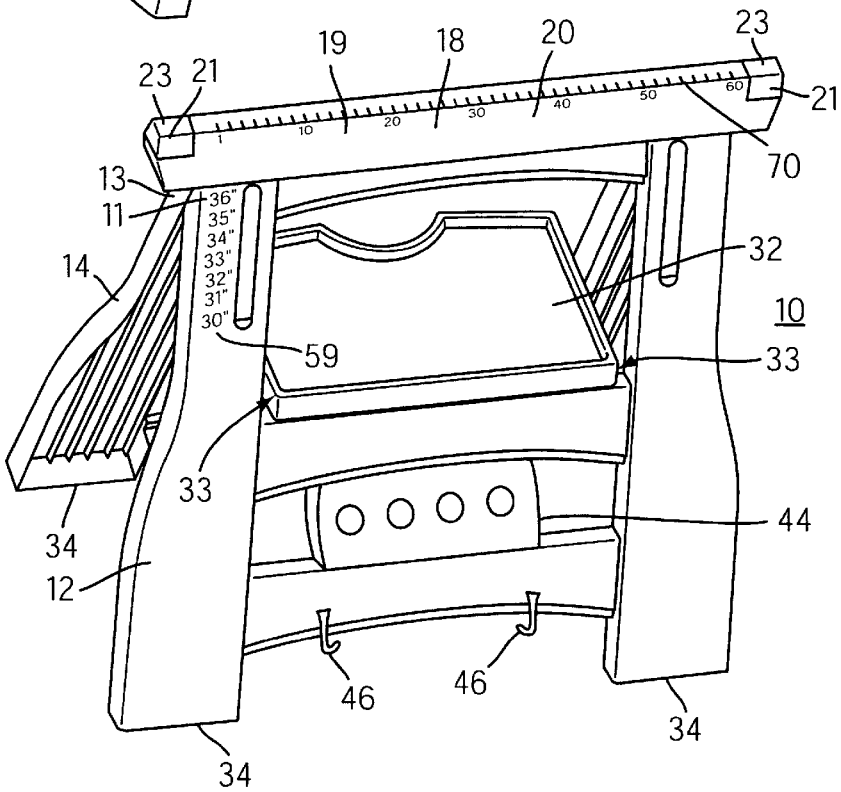
FIG. 2 is a second perspective view of the sawhorse of FIG. 1 shown here from a different angle.
Figure 3:
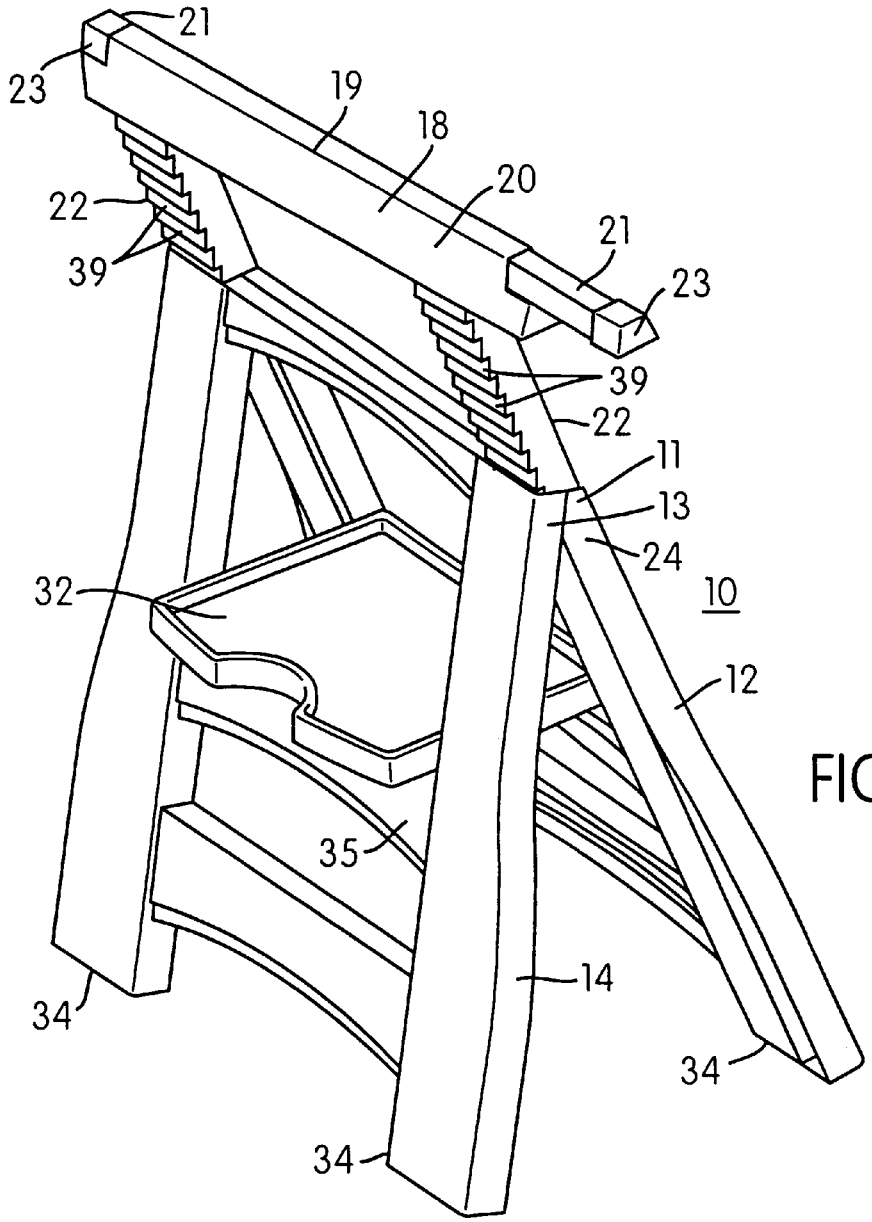
FIG. 3 is a perspective view of the height/working width adjustable sawhorse of FIG. 1 shown here in height and working width extended positions.
Figure 4:
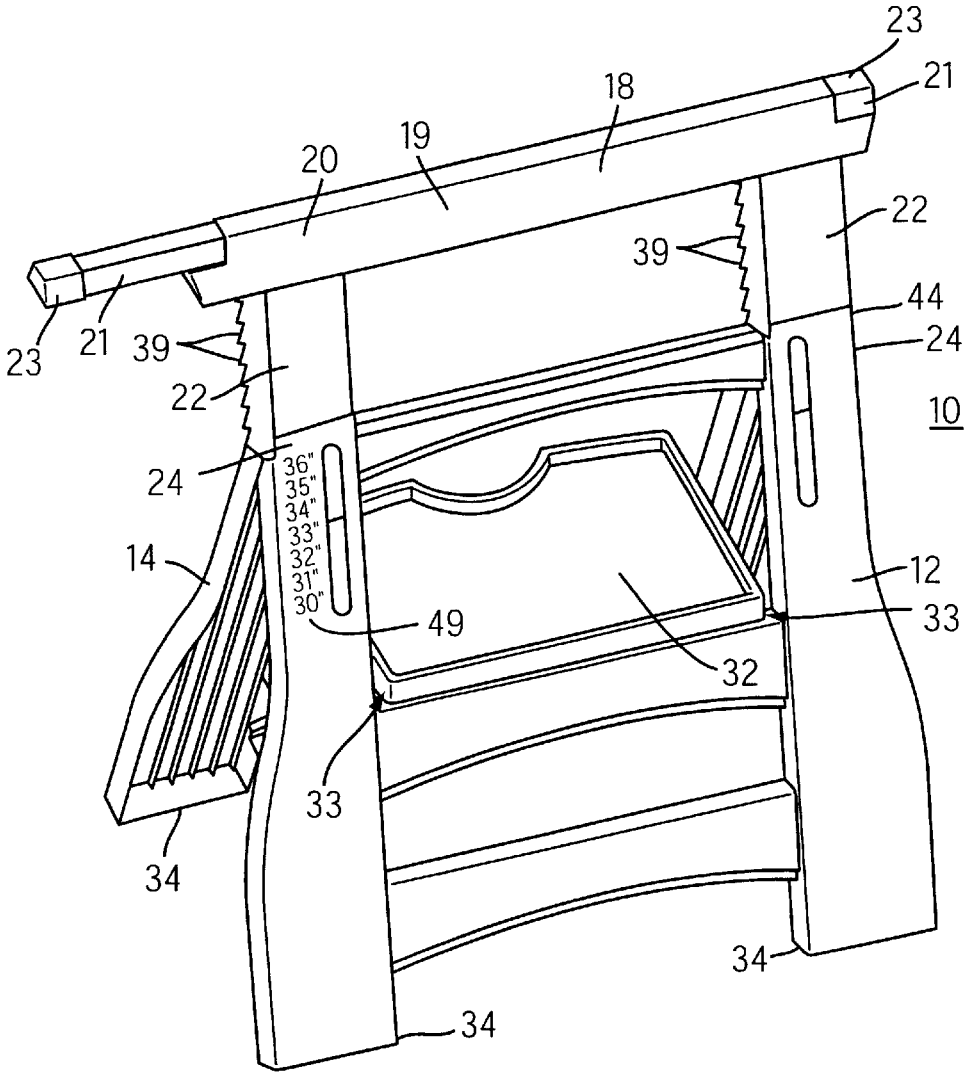
FIG. 4 is a perspective view of the height/working width adjustable sawhorse of FIG. 2 shown here in height and working width extended positions.
Figure 5:
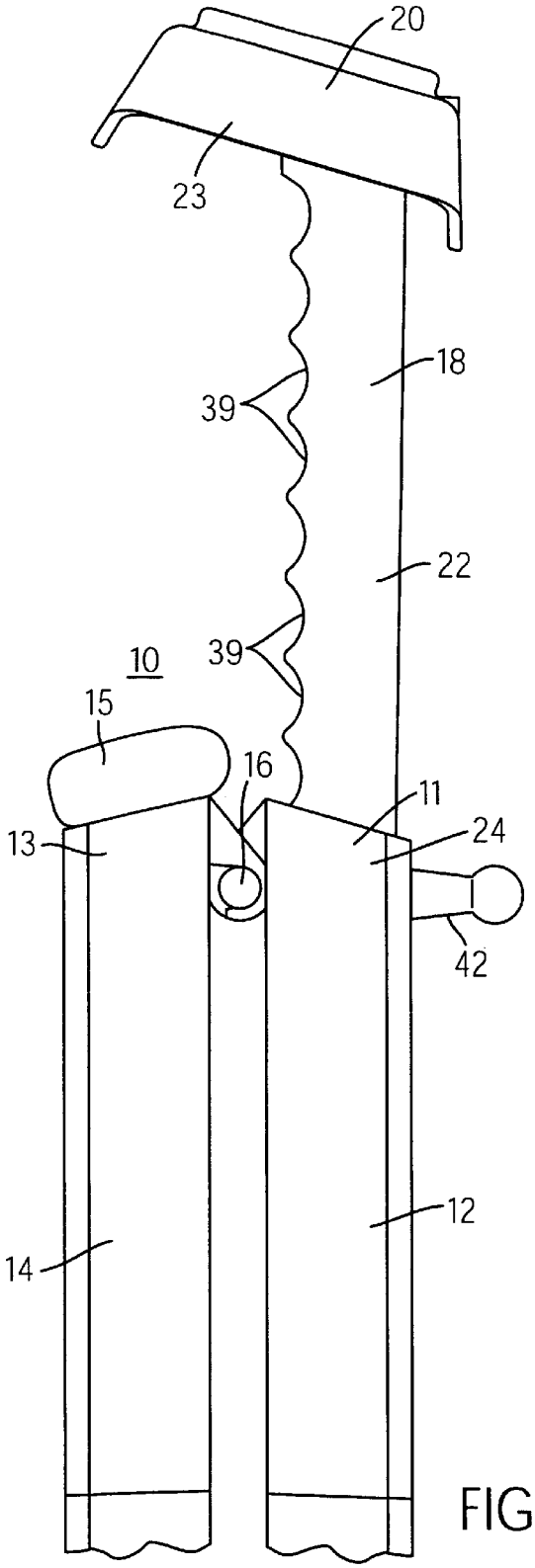
FIG. 5 is a side view of the height/working width adjustable sawhorse according to the first embodiment of the present invention in a folded position.

As best seen in FIGS. 2 and 4, according to another feature of a preferred embodiment of the present invention, a member, say the first base member 12, includes an elongated opening 48 through which extensions 22 are viewable, and a scale 49, depicted in FIGS. 2, 4, 7, and 8, aligned thereat or at extensions 22, so as to enable a user to record an extent to which the user wishes to extend or retract the top member 18 in the future, such that a plurality of users can, at different times, readily adjust sawhorse 10 to be compatible with their own heights.

According to another feature of a preferred embodiment of the present invention, an internal halting mechanism is provided to ensure that the extensions 18 cannot be fully removed from their respective engagement in their respective members (12, FIGS. 1–5 or 30, FIG. 6). Such halting mechanisms are well known in the art and do not require further description herein.

According to another feature of a preferred embodiment of the present invention, the base members 12 and 14 are supplemented with anti-slip rubber insets to prevent slippage of the sawhorse 10 when in use.

As shown in FIG. 2, according to yet another feature of a preferred embodiment of the present invention, the top member 18 features a ruler 70 (inches and centimeters).

FIGS. 7–11 show a third embodiment of the height adjustable and working width adjustable sawhorse, generally designated 100. The sawhorse 100 includes a base assembly on base structure 110 comprising a first base member 112 and a second base member 114. An extendible top member on workpiece support assembly 116 is movably mounted on the base structure 110.

Figure 7:
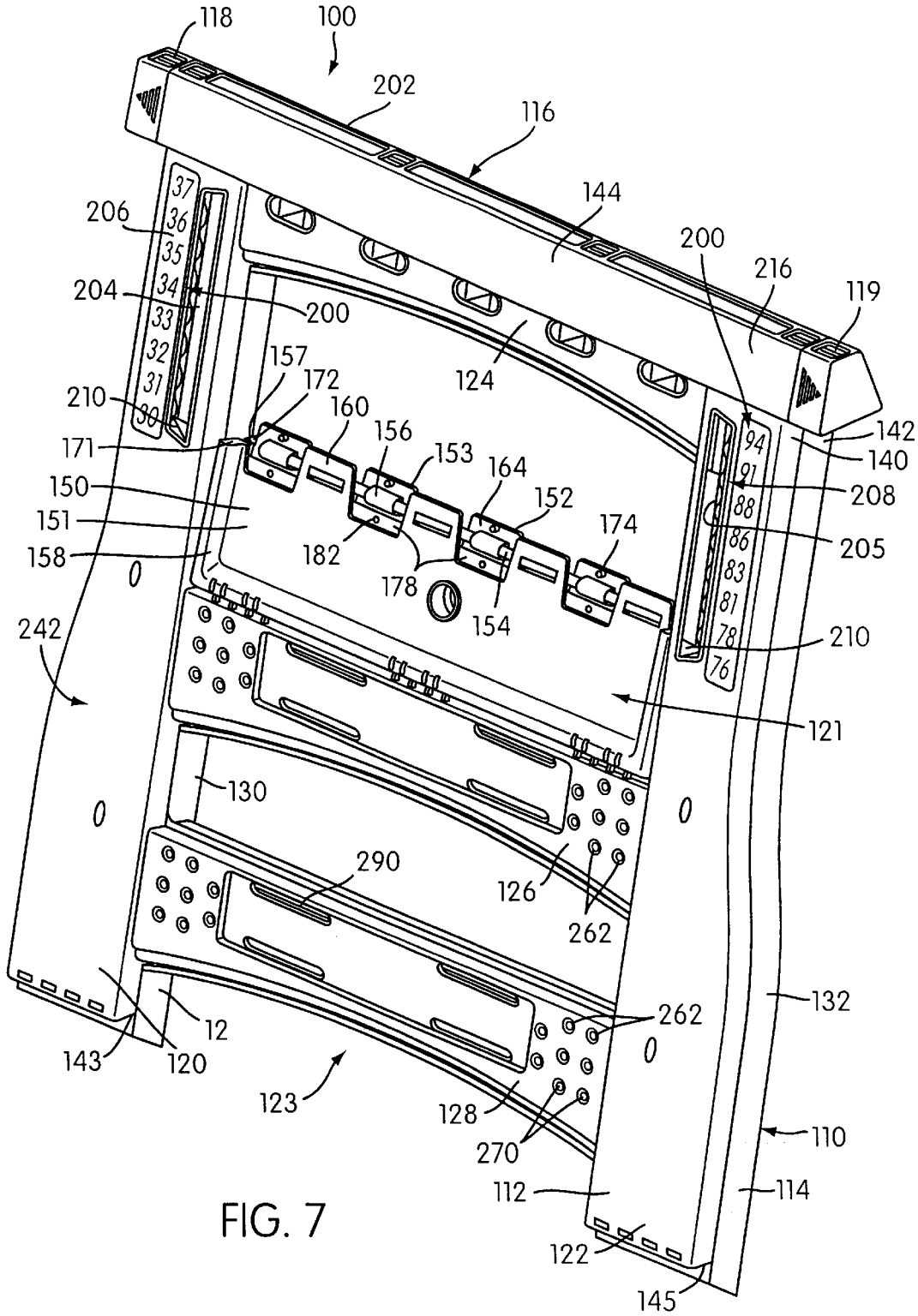
FIG. 7 is a perspective view of a height adjustable and working width adjustable sawhorse according to a third embodiment of the present invention in a folded position, and showing the height ruler on each side of the base member, with one side showing a height measurement in inches, and the other side showing a height measurement in centimeters.

The base structure 110 is movable between a closed position and an open position. The first and second base members 112, 114 are movably mounted together for movement between a closed folded position (to effect the closed position of the base structure 110) and an open operating position (to effect the open position of the base structure 110). The closed position of the base structure 112 is effected when the first and second base members 112, 114 are in their closed folded position (FIG. 7). The open position of the base structure 110 is effected 0when the first and second base members 112, 114 are in their open operating position (shown, for example, in FIGS. 8–11). The extendible top member 116 is constructed and arranged to support a workpiece when the base structure 110 is in its open position.

The extendible top member 116 is movably mounted to the base structure 110 for essentially vertical height adjusting movement with respect thereto to adjust the height of the sawhorse 100. A pair of laterally extendible arm members or arms 118, 119 are movably mounted in the extendible top member 116 for movement between retracted and extended arm positions to adjust the working width of the sawhorse 100.

Figure 8:
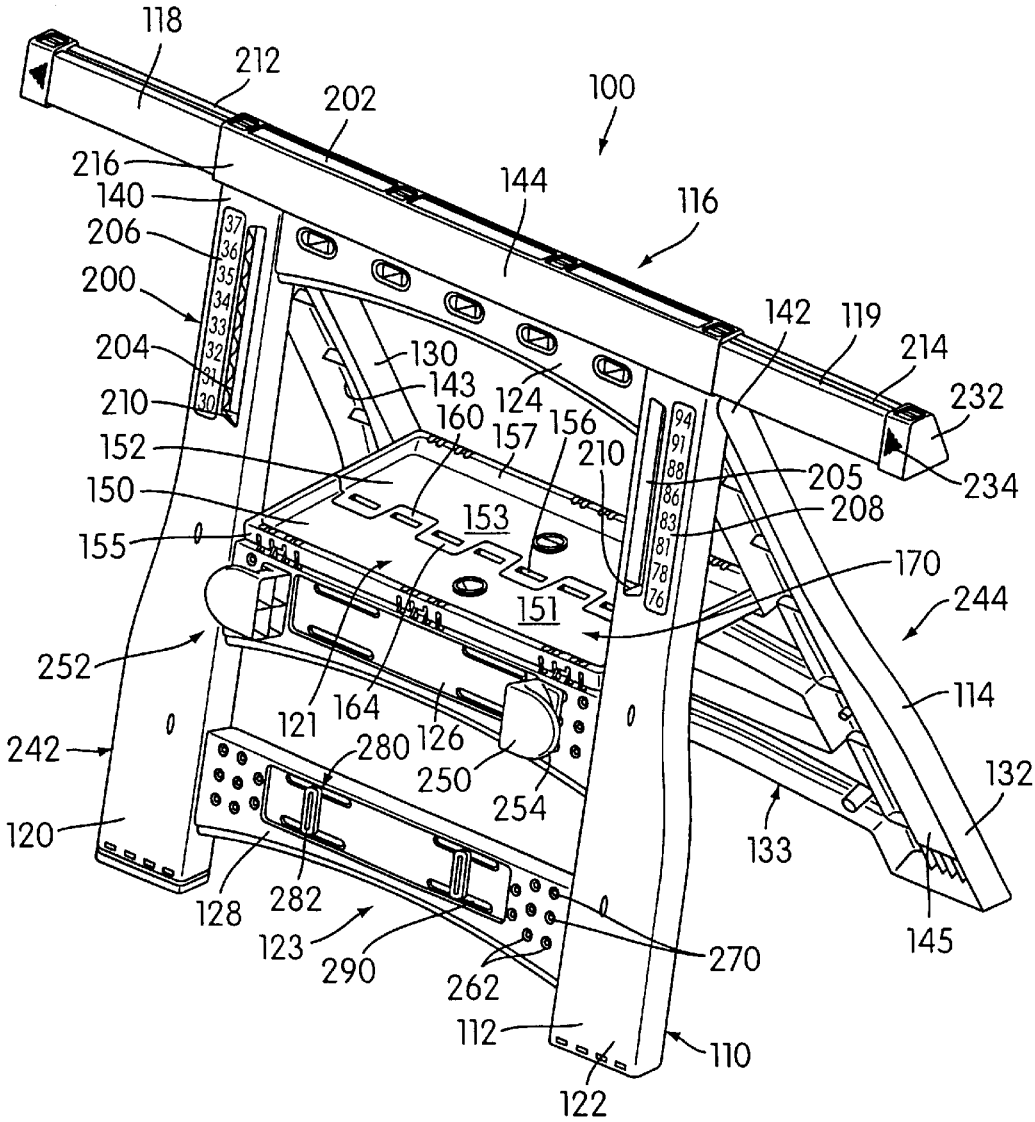
FIG. 8 is a perspective view of a height/working width adjustable sawhorse according to the third embodiment of the present invention shown with a fully expanded shelf between the two base members.

A spread limiting mechanism 121 is movably mounted on the base structure for movement between an inoperative folded position and a operative limiting position. More specifically, the spread limiting mechanism 121 is operatively associated with the first and second base members 112, 114 such that movement of base structure 110 between closed and open positions moves the spread limiting mechanism 118 between its inoperative folded position (FIG. 7) and its operative limiting position wherein it operates as a shelf (FIG. 8, for example). The spread limiting mechanism 118 in its operative limiting position limits the movement of the first and second base members 112, 114 in an unfolding or opening direction and provides a worker with a shelf-like support surface when using the sawhorse 100.

Figure 10:
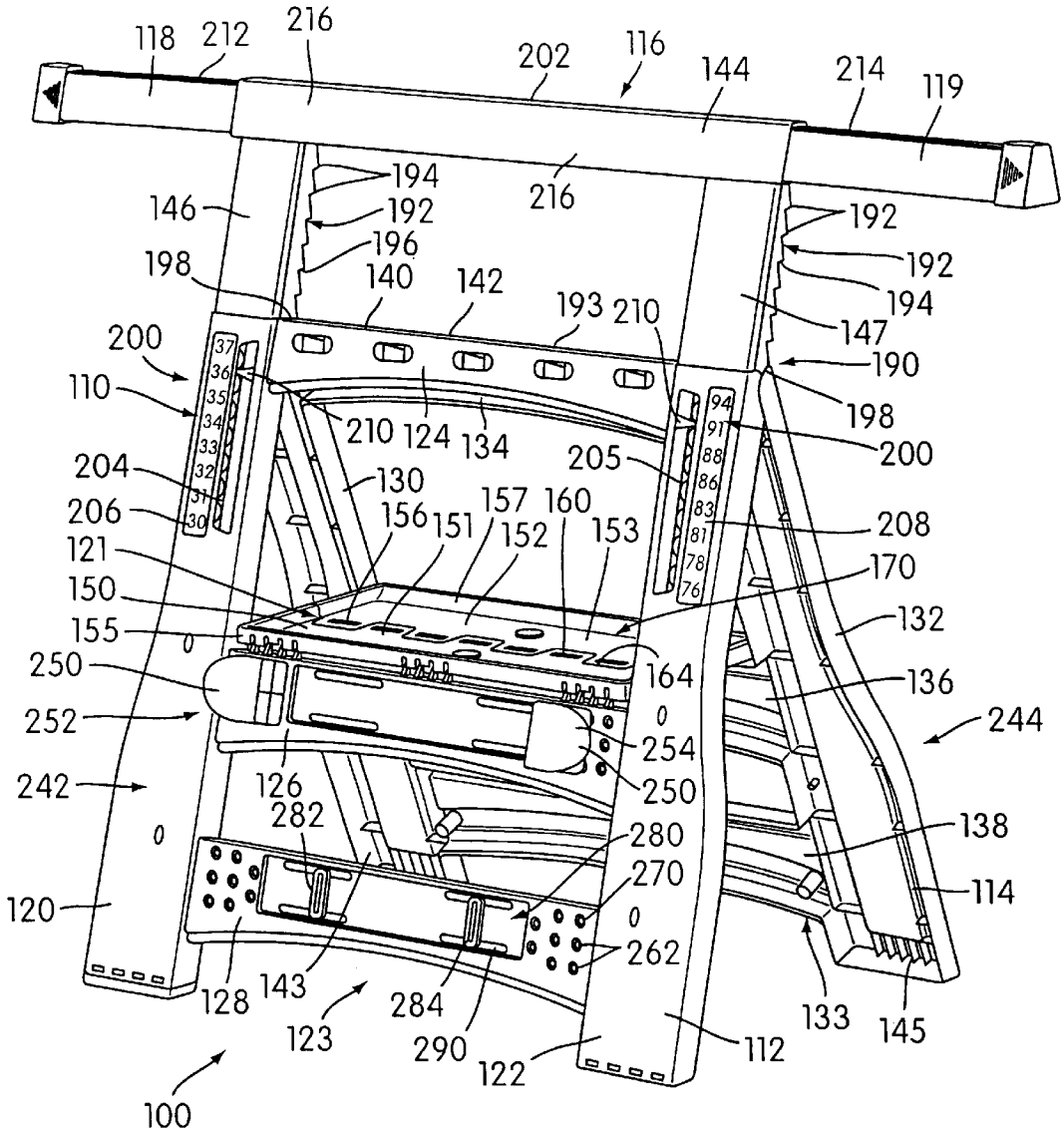
FIG. 10 is a perspective view of the height/working width adjustable sawhorse of FIG. 8 shown here in height and working width extended positions.
Figure 11:
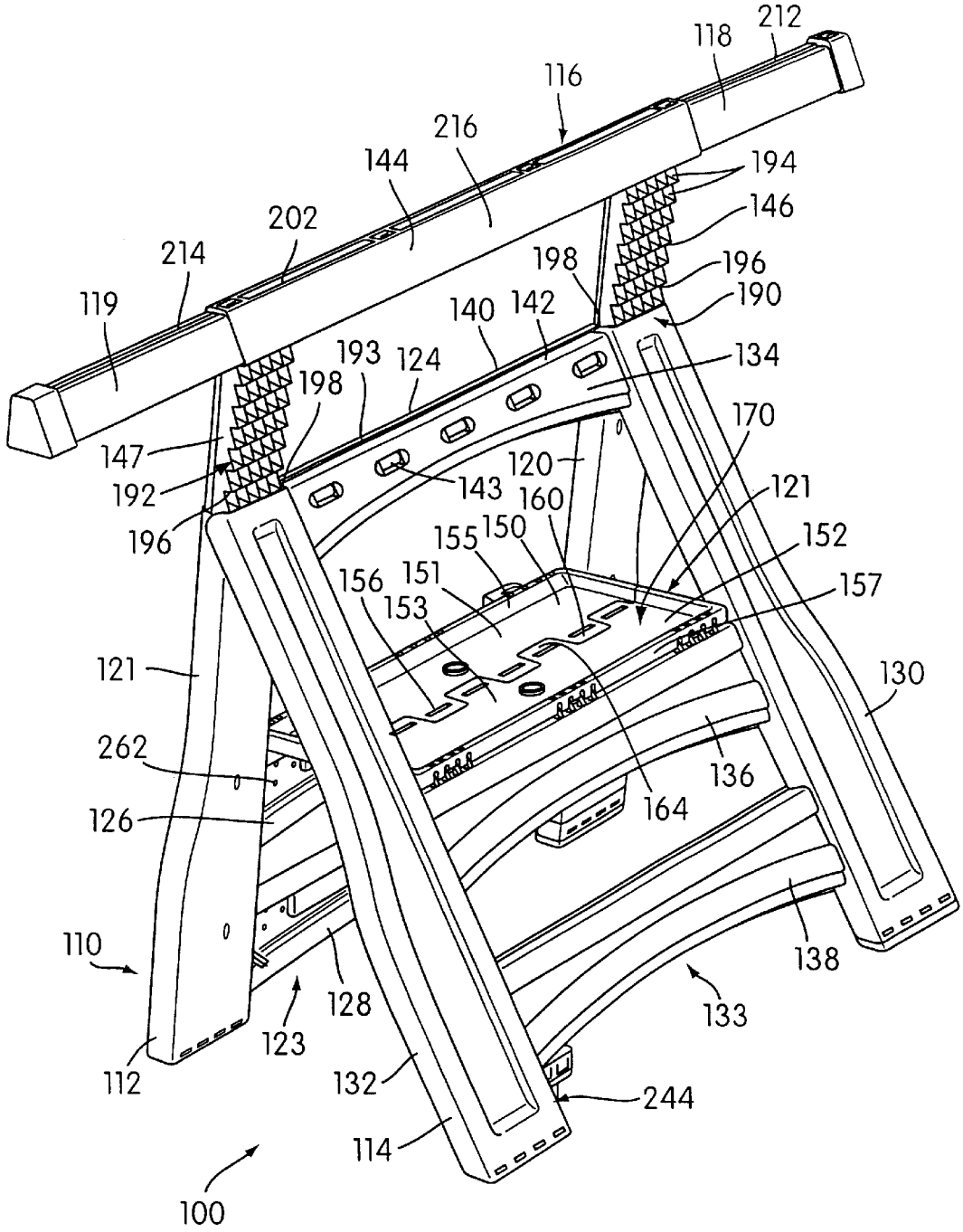
FIG. 11 is a perspective view of the sawhorse in FIG. 8 shown here from a different angle.

The structure of the sawhorse 100 can be best understood with particular reference to FIGS. 10 and 11. The first and second base members 112, 114 are each individual integral structures and are preferably each made of a suitable molded plastic. The first base member 112 includes a pair of elongated leg members 120, 122 and a plurality of integral cross members, generally designated 123, extending therebetween. The cross members 123 include an upper cross member 124, an intermediate cross member 126 and a lower cross member 128.

The second base member 114 includes a pair of elongated leg members 130, 132 and a plurality of integral cross members, generally designated 133, extending therebetween. The cross members 133 of the second base member 114 include an upper cross member 134, an intermediate cross member 136 and a lower cross member 138. The cross members 123, 133, respective, hold the associated pairs of leg members 120, 122 and 130, 132, respectively rigidly in spaced relation.

A first upper or top end 140 of the first base member 112 is hingedly connected to a second upper or top end 142 of the second base member 114 by a hinge 193 for pivotal movement between the closed folded position and the open operating position. Specifically, an elongated, preferably metal cylindrical rod 143 (FIG. 11) is interengaged with structure integrally formed on the respective top ends 140, 142 of the members 112, 114 to effect pivotal mounting.

The leg members 120, 122 have closed cross sections. The cross sections of the leg members 120, 122 are essentially rectangular and provide each leg member 120, 122 with a hollow, tubular construction. The leg members 130, 132 each have open, essentially C-shaped cross sections that provide each leg member 130, 132 with a recess 143, 145, respectively, constructed and arranged to receive the associated leg member 120 and 122, respectively, of the first base member 112 when the first and second base members 112, 114 are in their closed folded position (FIG. 7).

The top member 116 includes a top element 144 and at least one extension element extending therefrom. The exemplary sawhorse 100 includes two extension elements 146, 147. The extension elements 146, 147 are rigidly attached to opposite ends of the top member 116 and extend outwardly therefrom. The two extension elements 146, 147 are movably mounted on the base structure 110 for essentially vertical height adjusting movement so that the top member 116 can be raised and lowered to adjust the height of the sawhorse 100. Specifically, each of the two extension elements 146, 147 is movably mounted within the tubular interior of a leg member 120, 122, respectively, of the first base member 112 and each is releasably lockably engageable with structure on the second base member 114 to effect a range of sawhorse 100 heights.

Figure 9:
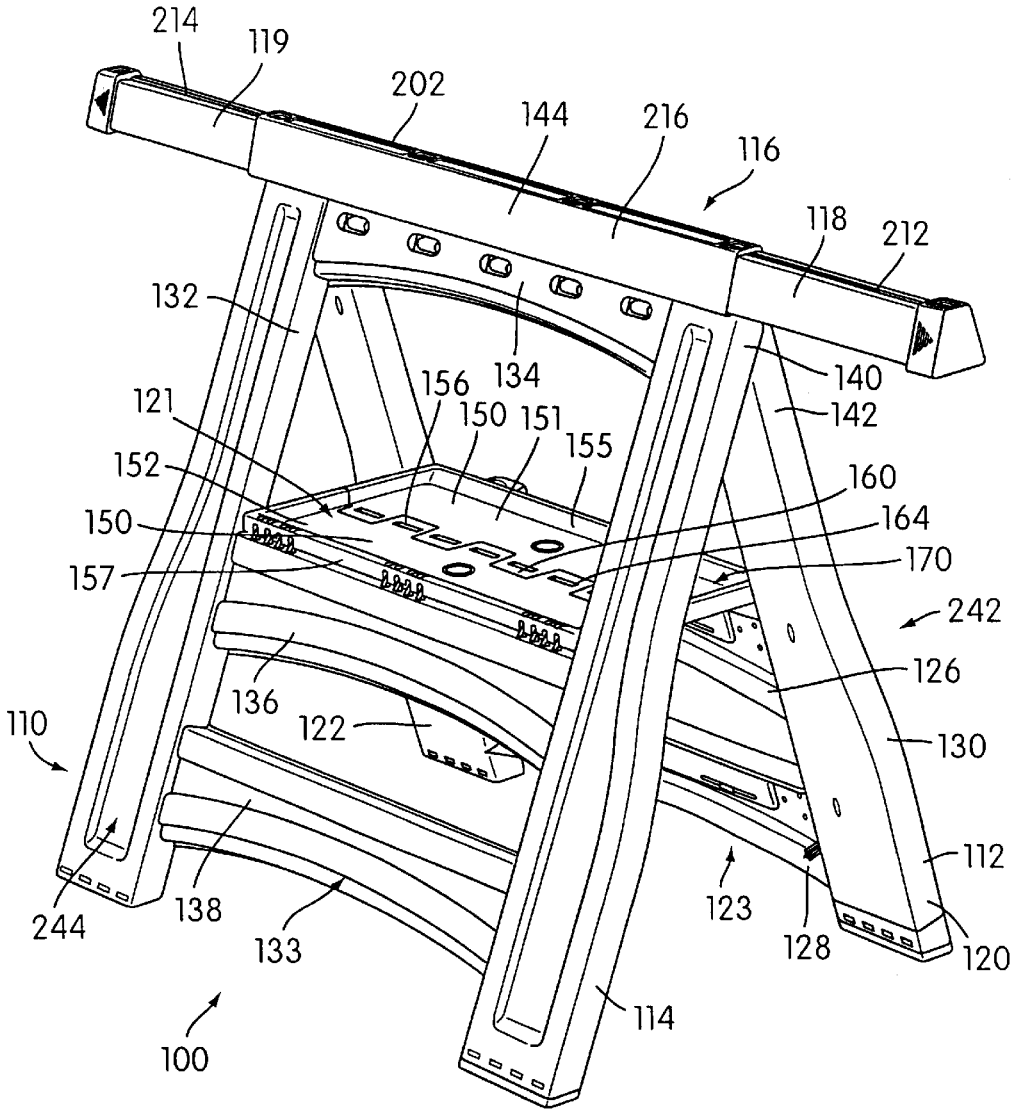
FIG. 9 is a perspective view of the sawhorse in FIG. 8 shown here from a different angle.

The structure of the spread limiting mechanism 121 can be best appreciated with particular reference to FIGS. 7–9. The spread limiting mechanism 121 includes two spread limiting parts or members 150, 152. The first spread limiting member 150 is pivotally mounted to the intermediate cross member 126 of the first base member 112 (FIG. 8, for example) by a rigid elongated pin (not shown). The second spread limiting member 152 is pivotally mounted to the intermediate cross member 136 of the second base member 114 (FIG. 9, for example) by a rigid elongated pin (not shown). Each spread limiting member 150, 152 is preferably an integral structure constructed of a suitable molded plastic. Each spread limiting member 150, 152 includes a base wall portion 151, 153, respectively, and a peripheral wall portion 155, 157, respectively. Each base wall portion 151, 153 includes a plurality of outwardly projecting wall portions 160, 164, respectively.

The first and second spread limiting members 150, 152 are pivotally mounted together by an elongated rigid cylindrical shaft 154 that extends through U-shaped brackets 156 integrally formed on a spread limiting members 150, 152 (FIG. 7, for example). Specifically, each bracket 156 is provided on a projecting wall portion 160, 164.

The sawhorse 100 is normally stored in its closed position as shown in FIG. 7. To set up the sawhorse 100 for use, the sawhorse user pivots the first and second base members 112, 114 about the hinge 193 from their closed folded position toward and into their open operating position (FIG. 8, for example). The pivotal movement of the first and second base members 112, 114 moves the spread limiting mechanism 121 from its inoperative folded position (FIG. 7) into its operative limiting position (FIG. 8, for example). When the spread limiting mechanism 121 is in its folded position, the base wall portions 151, 153 thereof are essentially parallel and disposed between the folded leg members 120, 122, 130, 132. When the spread limiting mechanism 121 is in its operative limiting position, the base wall portions 151, 153 are essentially co-planar and cooperate to provide the user with a flat shelf-like surface 170 (FIG. 8, for example) that can support a variety of items including hand tools and the like when the sawhorse 100 is in use. The peripheral wall portions 155, 157 surround the periphery of the shelf like surface 170 when the spread limiting mechanism 121 is in its operative limiting position to the preventive objects on the shelf like surface 170 from sliding off the surface 170 and falling on the ground.

A plurality of structures on the spread limiting mechanism 121 limit the movement thereof in the unfolding direction and provide the surface 170 with strength and rigidity. Specifically, end surfaces 171, 172 are provided on the peripheral wall portions 155, 157, respectively. An integral post member 174 is provided on each outwardly projecting wall portion 160, 164. A recessed area 178 is provided on each base wall portion 151 opposite each outwardly projecting wall portion 164 on the base wall portion 153. Similarly, a recessed area 180 is provided on each base wall portion 153 opposite each outwardly projecting wall portion 160 on the base wall portion 151. An aperture 182 is provided in each recessed area 178, 180. As can best be appreciated from a comparison of FIGS. 7 and 8, when the spread limiting mechanism 121 moves into its operative limiting position, the end surfaces 170, 172 move into abutting relation and each post member 174 engages an associated aperture 182 to limit movement of the mechanism 121 in its unfolding direction and to strengthen and rigidify the support surface 171.

It can be understood that when the spread limiting mechanism 121 is in its operative limiting position, the mechanism 121 limits the outward movement of the first and second base members 112, 114 in their unfolding direction. It can also be understood that because the base wall portions 151, 153 of the spread limiting mechanism 121 are essentially co-planar, the mechanism 121 also operates to rigidify and strengthen the base structure 110 in its open position. Specifically, the spread limiting mechanism 121 prevents movement of the first and second base members toward their closed folded position until the user manually moves the spread limiting mechanism back towards its folded position. This is considered in greater detail below.

The height of the sawhorse 100 can be easily adjusted by selectively adjusting the position of the extendible top member 116 with respect to the base structure 110. The top member 116 is normally placed in its lowermost position (FIGS. 7 and 8, for example) when the sawhorse 100 is stored. To raise the position of the top member 116, the user lifts the same, thereby causing the extension elements 146, 147 to move outwardly of the respective leg members 120, 122 on the first base member 112. The sawhorse 100 includes securing structure 190 for releasably securing the top member in a raised position with respect to the base structure 110.

Specifically, in the preferred embodiment, each extension element 146, 147 is provided with a series of receptive regions 192 that are constructed and arranged to accept and lockingly engage portions of the second base member 114. The securing structure 190 of the sawhorse 100 can best be understood with particular reference to FIG. 11. The receptive regions 192 are provided by a series of teeth 194 integrally formed on each extension element 146, 147. The lockingly engaged portions of the second base member 114 are provided by the second top end 142 thereof. Each tooth 194 includes a lower edge surface 196 that is constructed and arranged to abuttingly engage locking surfaces 198 formed at opposite ends of the second top end 142 to releasably hold the top member 116 in a selected raised position. The member 116 can be easily lowered toward and into its lowermost position by grasping the top member 116 and folding the base assembly to manually move the surfaces 196, 198 laterally out of locking and abutting engagement. The user can then easily lowered the top member with respect to the base structure because the hollow tubular interior of each leg member 120, 122 is sized to receive the respective extension element 146, 147 including the outwardly projecting teeth 194.

The sawhorse 100 includes a height measuring assembly, generally designated 200, to indicate to the user the vertical height of a workpiece supporting upper surface 202 of the top member 116. The construction and operation of the assembly 200 can best be appreciated by comparing FIGS. 8 and 10. An elongated opening 204, 205 is provided in the upper portion of respective leg members 120, 122 of the first base member 112. A measuring scale 206, 208, is provided on the first base member 112 in association with a respective elongated opening 204, 205. A pointer arm 210 is rigidly attached or integrally molded with each extension element 146, 147 to and is constructed and arranged to point to an associated measuring scale 206, 208. The measuring scales 206, 208 are a series of numbers and other appropriate markings. The pointer arms 210 and the scales 206, 208 are calibrated to indicate the vertical height of the upper surface 202 of the top member 116 with respect to the ground surface when the sawhorse 100 is in its operating position. Thus, when the user raises and lowers the top member 116, the arms 210 move therewith to indicate the height of the upper surface 202. The scale 206 indicates the height of the surface 202 in inches and the scale 208 indicates the height in centimeters.

The extendible arms 118, 119 of the top member 116 are constructed and arranged to move between their retracted arm positions (FIG. 7) and extended arm positions (FIGS. 8–11) to adjust the width of the top member 116 of the sawhorse 100. It can be understood from a comparison of FIGS. 7 and 8, for example, that moving the extendible arms 118, 119 outwardly of the top member 116 increases the effective width of the upper surface of the sawhorse 100 because upper surfaces 212, 214 on respective arms 118, 119 effectively increase in the width of the surface 202.

Figure 17:
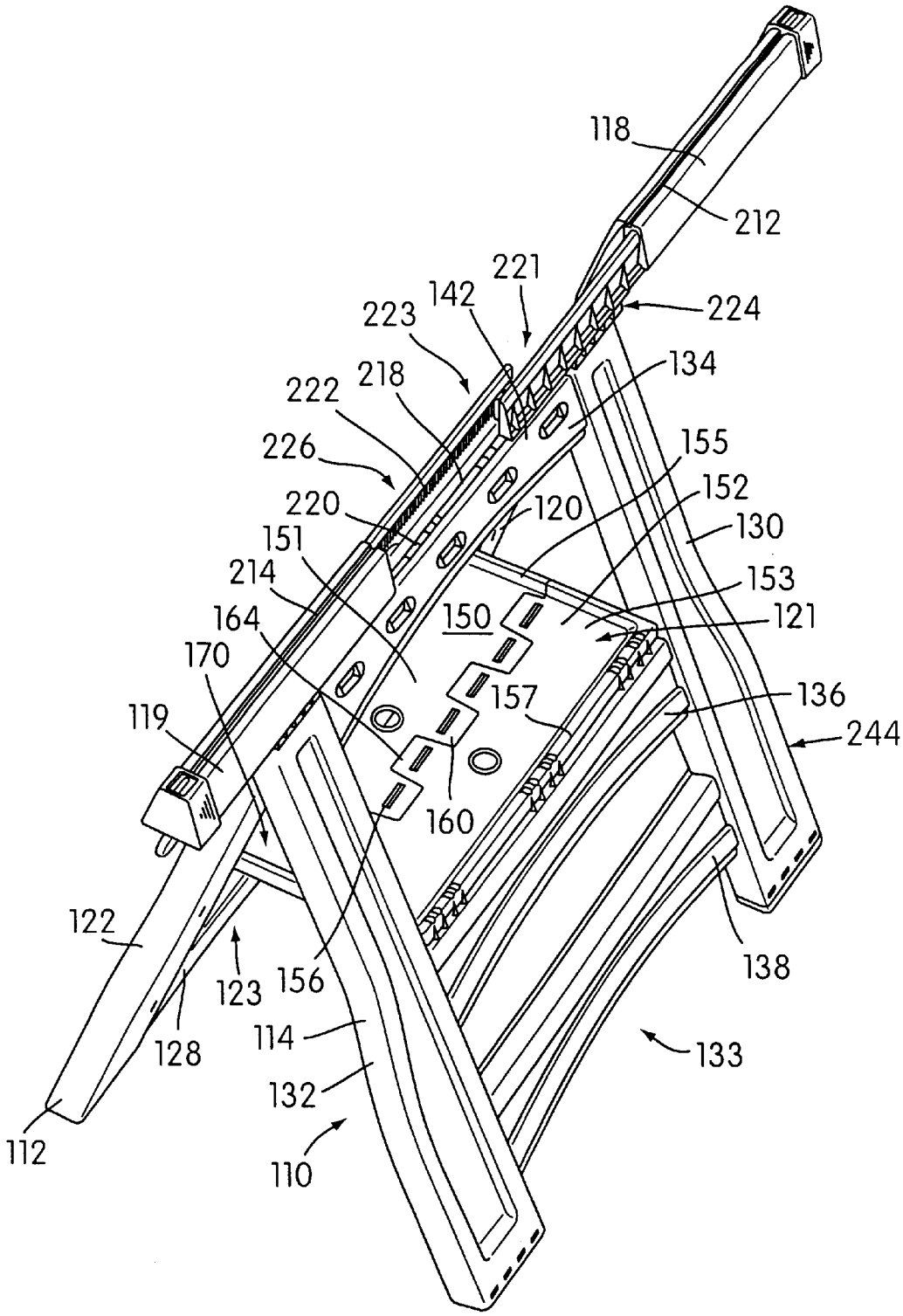
FIG. 17 is a cutaway view of the height adjustable and working width adjustable sawhorse of FIG. 8 showing an interior portion of the top member, which can be extended horizontally from both sides by pulling on either side of the top member.
Figure 18A:
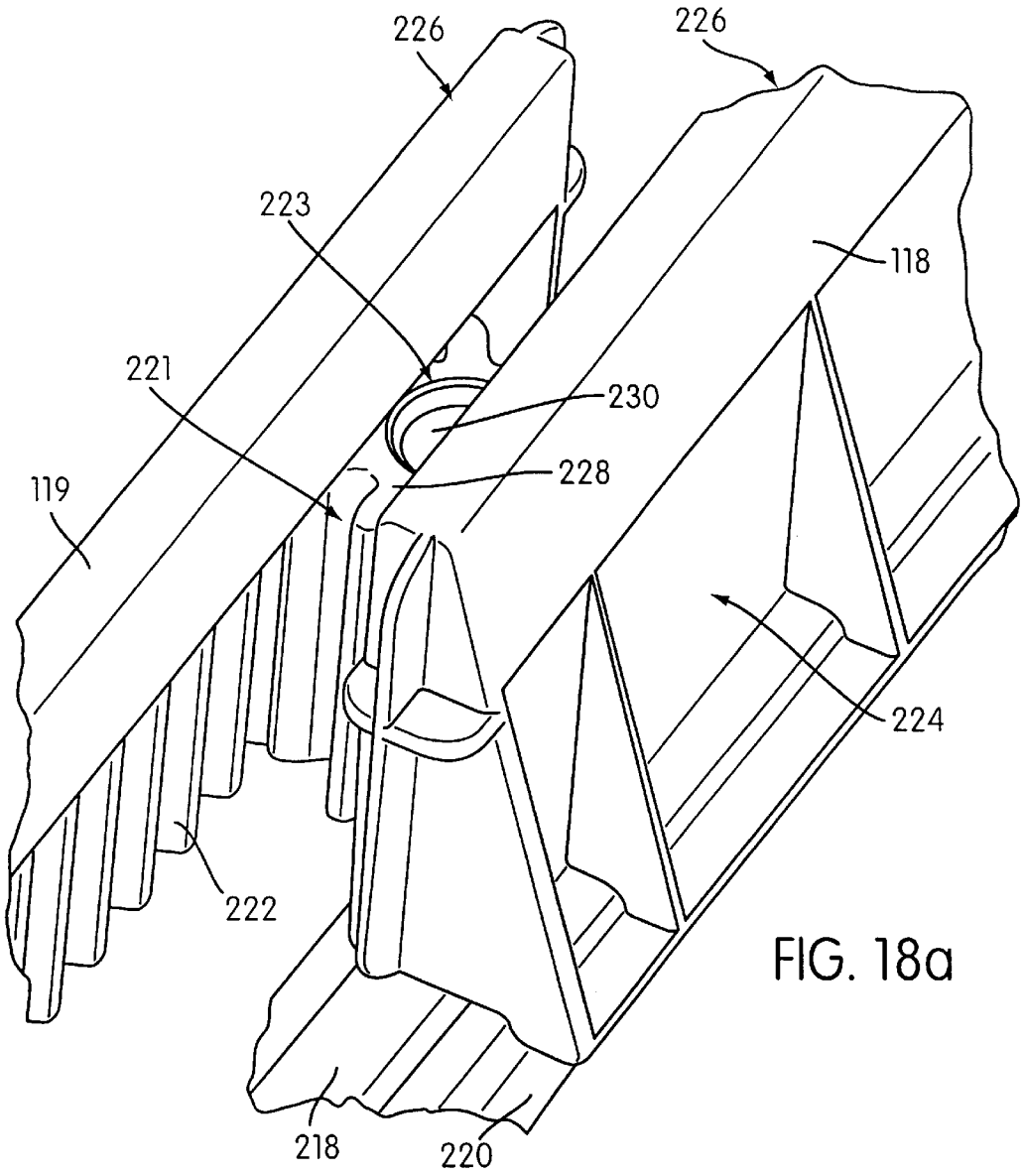
FIGS. 18*a* and 18*b* depict the gear mechanism used inside the top member in FIG. 17.
Figure 18B:
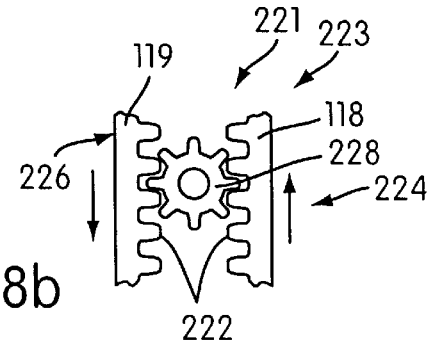

The structure and operation of the top member 116 and the manner in which the arms 118, 119 move between retracted and extended positions can best be understood from an examination of FIGS. 17, 18*a* and 18*b*. FIGS. 17 shows the arms 118, 119 in their fully extended positions with a cover member 216 of the top member 116 removed and not shown. Each arm 118, 119 is slidably mounted on a track structure 218 integrally formed on a cross portion 220 of the top member 116. Preferably, the cross portion 220 is an integral plastic structure that is formed integrally with the extension elements 146, 147 and is rigidly secured therebetween. An arm moving motion transmitting assembly 223 is provided by the top member 16. The arm moving assembly 223 operatively connects the arms 118, 119 together such that manual movement of an arm 118 or 119 in an arm retracting or an arm extending direction effects simultaneous like movement of the other arm 118 or 119 such that movement of one arm 118 or 119 between arm extended and arm retracted positions simultaneously moves the other arm 118 or 119 in like manner.

In the exemplary embodiment of the sawhorse 100 shown, the arm moving assembly 223 is embodied in a gear assembly, generally designated 221. The structure and operation of the gear assembly 121 can be best understood with reference to FIGS. 17–18*b*. Each arm 118, 119 is preferably an integral molded plastic structure that is provided with a series of gear assembly engaging teeth 222 formed integrally along respective end portions 224, 226 of each arm 118, 119. A pinion or central gear 228 of the gear assembly is rotatably mounted in a central region of the cross portion 220 by a shaft 230. The central gear 228 is constructed to engage simultaneously the teeth 222 on both arms 118, 119 and affect simultaneous movement thereof as an aforesaid.

It can be understood that manual movement of either arm 118 or 119 by the user in either the arm extending or retracting direction causes rotation of the central gear 228 to effect movement of the opposite arm so that it too will move in the same extending or retracting manner.

Stop structure (not shown) is provided on the top member 116 to limit the outward movement of the arms 118, 119 in the arm extending direction to prevent the arms 118, 119 from being removed from the top member 116 during normal use of the sawhorse 100. End caps 232 are provided on the free ends of the arms 118, 119 to provide easily grippable structure on each arm to facilitate arm movement and to limit arm movement in the arm retracting direction. Directional arrows 234 are provided on each end cap 232 and point in the arm extending direction of each arm 118, 119. When the arms 118 and 119 are in their retracted positions, the end caps 232 abuttingly engage an associated edge of the cover member 216. Preferably, the cover member 216 is an integral structure preferably made of a molded plastic. The cover member is constructed and arranged to easily snap fit into engagement with the cross portion 220 of the top member 116. The cover member 216 is constructed and arranged to hold the arms 118, 119 in slidable engagement with the track structure 218 and to hold the arms in operative engagement with the gear assembly 221.

To return the sawhorse 100 to its storage position, the user manually moves an arm 118 or 119 toward and into its arm retracted position. This causes simultaneous movement of the other 118 or 119 toward and into its retracted position as an aforesaid. The user then folds the base assembly and moves the top member 116 to its lowermost position (FIG. 7) as an aforesaid. To affect the folding movement of the base members 112, 114, the user lifts the hinged central portion of the spread limiting mechanism 121 upwardly in its folding direction. Two holes 240 are provided in the base wall portions 151, 153 to allow the user to easily move the mechanism 121 out above its operative spread limiting position in its folding direction toward its folded position. Once this folding movement of the mechanism 121 is commenced, the user can easily fold the sawhorse 100 to its closed position by manually pivoting the first and second base members together.

It can be appreciated from FIG. 7 that when the sawhorse 100 is in its folded position, it can be easily carried and stored. Specifically, because the leg members 120,122 are received in nested relation within the intenion spaces or recesses provided by the legs 130, 132, the width of the folded sawhorse 100 is approximately equal to know width of one of the leg members of thereof. It can also be appreciated that in the folded position of the front and back portions, generally designated 242 and 244, respectively, of the sawhorse 100 are essentially parallel so that a plurality of sawhorses 100 can be easily stacked.

It can be appreciated that because sawhorses are typically used in pairs to support a workpiece, a user must typically carry a pair of sawhorses 100 to a work site and store them after the work is completed. The folding ability of the sawhorses 100 makes carrying a pair of sawhorses simultaneously relatively easy. It can also be appreciated that because the sawhorses are used in pairs, it is usually desirable, when setting them up, to adjust both sawhorses 100 to have the same vertical height dimension so that a workpiece supported between them is level. The height measuring assemblies allow the worker to quickly and easily make both sawhorses 100 the same height when setting up the same as a work site.

Workers using sawhorses typically use power tools in conjunction therewith. It is therefore frequently necessary to have a source of electrical power at the work site where the sawhorses are being used. Electrical power is usually provided at a work site by electrical outlets and by electrically conductive extension cords. A plurality of attachments are provided by the invention for use with the sawhorse 100 to mount an electrical power cord on the sawhorse 100 for power cord storage and used. A plurality of attachments are also provided by the invention to mount a power strip to the sawhorse 100 to provide a plurality of electrical outlets at the work site.

Figure 12:
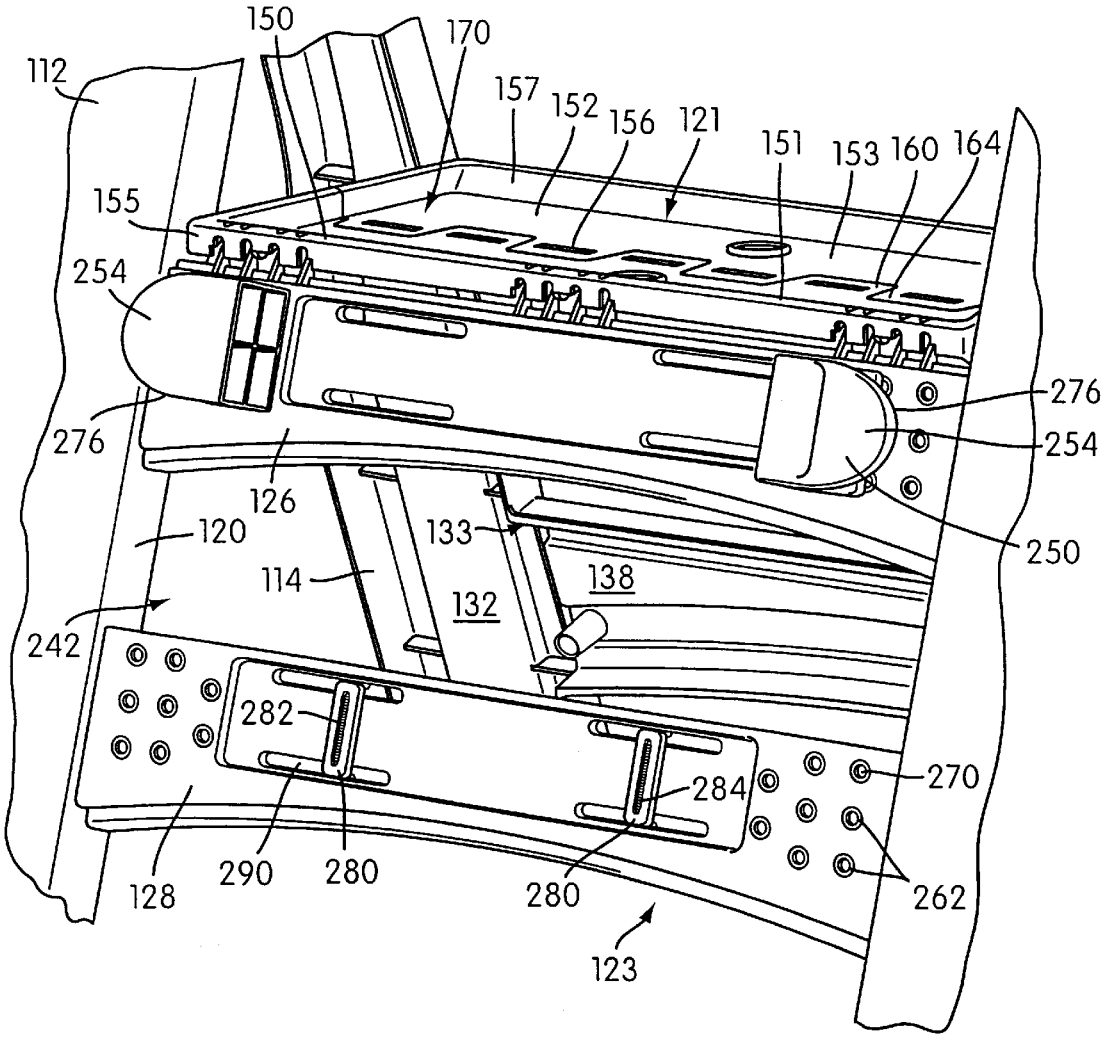
FIG. 12 is a perspective view of the sawhorse in FIG. 8 showing the cable holder, the socket holder and a grid for attaching accessories.
Figure 13:
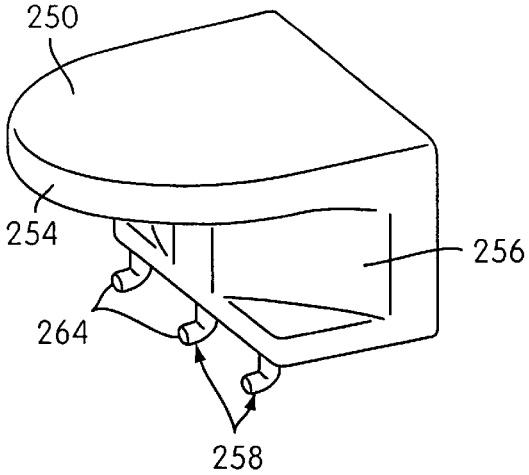
FIGS. 13 and 14 are perspective views of the cable holder shown in different angles.
Figure 14:
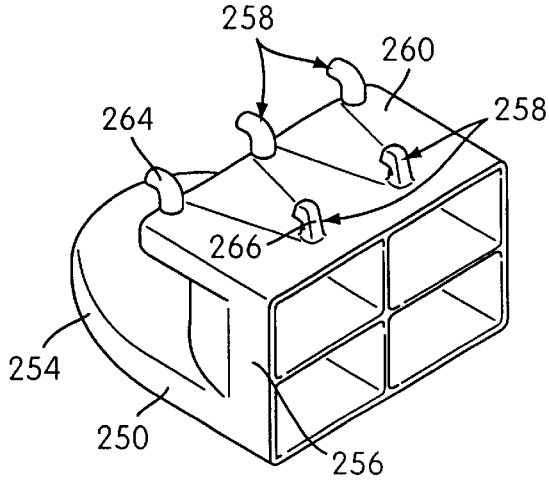

FIGS. 10 and 12–14 show a cord holder member 250 of a cord holder assembly 252 that is constructed and arranged to be removably attached to the cross member 126. The cord holder assembly 252 includes a pair of cord holder members 250 that are mounted in pairs on the sawhorse 100. Only one cord holder member 250 of the assembly 252 is shown in FIGS. 13 and 14 because both pair members are of identical construction. Each cord holder member 250 is preferably an integral plastic structure that includes a outer wall portion 254, a body portion 256 and interengaging structure 258 integrally formed on a bottom surface 260 of the body portion 256. The interengaging structure 258 is constructed and arranged to releasably engage interengageable structure 262 integrally formed on the first base member 112. Specifically, the interengaging structure 258 includes a plurality of hook members 264 and a plurality of leg members 266. The interengageable structure 262 includes a series of apertures 270 formed on the intermediate of cross member 126 and lower cross member 128 of the first base member 112. The apertures 270 are spaced to form a grid pattern constructed and arranged to receive and releasably interengage the hook members 264 and leg members 266 to removably secure the holder members 250 in cooperating pairs to the base structure 210.

It can be appreciated that when the holder members 250 are mounted in cooperating pairs the assembly 252 is constructed and arranged to receive a power cord in winding relation there about generally within the groove 276 formed within the body portion 256 of each holder member and between outer wall portion 254 and the cross member 126.

Figure 15:
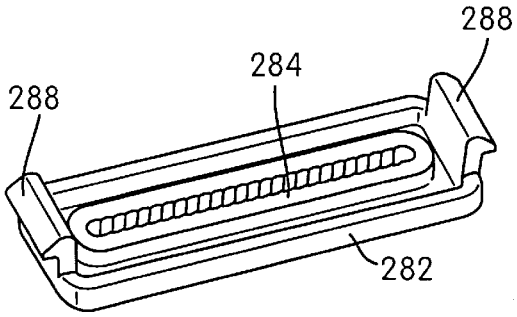
FIGS. 15 and 16 are perspective views of the socket holder shown in different angles.
Figure 16:
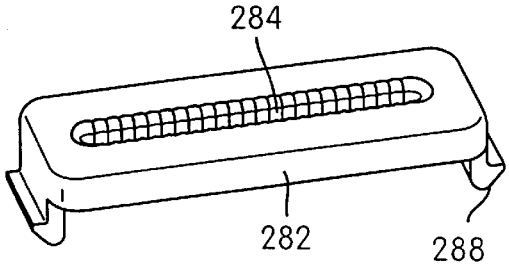

A power strip mounting assembly 280 is provided for mounting a power strip to the lower cross member 128 (see FIG. 12). The power strip mounting assembly 280 includes a pair of power strip mounting brackets 282, one of which is shown in FIGS. 15 and 16. Each bracket 282 is constructed and arranged to the mounted on a power strip and then releasably interengaged with the cross member 128. The brackets 282 are typically mounted to the opposite ends of a conventional elongated power strip using the conventional fasteners provided by such power strips for mounting the same to a wall or floor. The screws extend through an elongated opening 284 in the brackets 282 to secure the power strip. The elongation of the opening 284 allows power strips of different widths to be mounted to the bracket 282. Each bracket 282 is preferably an integral structure constructed of molded plastic and includes two hook structures 288 constructed and arranged to hookingly engage pairs of elongated slots 290 formed on the cross members 126, 128. The slots 290 permit sliding movement to adjust the distance between brackets 282 to accommodate power strips of different lengths.

It can be appreciated the use of the cord holder assembly 250 and power strip mounting assembly 280 is optional. The removable mounting of the assemblies 250, 280 allows a user to easily temporarily mount a cord and power strip to the sawhorse 100 and then easily removed in the same so that the sawhorse can be easily carried stored and stacked when in the folded position.

The sawhorse according to the present invention enjoys several advantages over the prior art.

For example, being height adjustable at an upper portion thereof, it eliminates the limitations associated with height adjustment at the bottom, characterizing prior art height adjustable sawhorses, as further detailed in the Background section hereinabove.

In addition, being working width adjustable at an upper portion thereof, it enables more diversified applications.

Furthermore, featuring housing overlapping and housed overlapped members it provides solidness, firmness and stability which are not accompanied by robustness in the collapsed position.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A sawhorse, comprising:

a base assembly movable between a folded storage position and an open operative position in supported relation on a horizontal surface;

a workpiece support assembly having a workpiece supporting surface which faces upwardly when the base assembly is in the operative position thereof, said workpiece support assembly being mounted on the base assembly for vertical movement in opposite directions with respect to the base assembly through a range of vertical positions;

the base assembly and the workpiece support assembly having cooperating structure operable when the base assembly is in the storage position thereof to enable the workpiece support assembly to be manually moved in said opposite directions into a selected position of movement with respect to the base assembly and said cooperating structure being operable in response to the movement of the base assembly from the storage position thereof with said workpiece support assembly in a selected position into the operative position thereof to prevent said workpiece support assembly from downward movement out of said selected position so as to position the workpiece support surface a selected distance above the horizontal surface on which the base assembly is supported in the operative position thereof.

2. A sawhorse as defined in claim 1, wherein the movement of the base assembly from the storage position thereof into the operative position thereof with said workpiece support assembly in said selected position further locks the workpiece support assembly in the selected relative position thereof to prevent upward movement of the workpiece support assembly with respect to the base assembly.

3. A sawhorse as defined in claim 2, wherein the workpiece support assembly includes a pair of elongated extension elements and wherein the base assembly includes spaced openings constructed and arranged to receive the pair of extension elements for relative movement between the extensions elements and said openings to thereby provide said movement in said opposite directions between said workpiece support assembly and the base assembly as aforesaid and wherein the base assembly further includes spaced structure that moves into a position of locking engagement with the extension elements in response to movement of the base assembly from the storage position thereof into the operative position thereof to lock the workpiece support assembly in the selected relative position thereof with respect to the base assembly as aforesaid.

4. A sawhorse as defined in claim 3, wherein each said extension element includes a plurality of teeth and wherein said spaced structure comprises a pair of locking surface portions of the base assembly, each said surface portion of the base assembly being constructed and arranged to lockingly engage a selected one of said teeth of an associated extension element in response to movement of the base assembly from the storage position thereof into the operative position thereof.

5. A sawhorse as defined in claim 4, further comprising a height measuring assembly associated between the base assembly and one of the extension elements and constructed and arranged to indicate a height to which the workpiece support assembly has been extended.

6. The sawhorse of claim 5, wherein said height measuring assembly comprises a height measuring indicia on the base assembly, and an indicator on one of the extension elements for indicating a height of the workpiece support assembly utilizing the indicia.

7. A sawhorse as defined in claim 1, wherein the workpiece support assembly includes an elongated top member and a pair of elongated arm members, the elongated top member extending horizontally and providing the upwardly facing workpiece supporting surface when the base assembly is deployed in the operative position thereof, each arm member being movably mounted within a hollow open opposite end of the top member for movement between retracted and extended positions with respect to the respective end thereof, the deployed workpiece support assembly having structure constructed and arranged (a) to support a portion of a relatively narrow workpiece on the upper support surface of the top member thereof when the arm members are in their retracted positions and (b) to support a portion of a relatively wide workpiece on the upper support surface of the top member thereof when the arm members are in their extended positions.

8. A sawhorse as defined in claim 7, wherein said workpiece support assembly further includes a motion transmitting assembly operatively connecting the arm members thereof to one another to enable a manual movement of either arm member to transmit an equal and opposite movement to the other arm member to allow a sawhorse operator to extend or retract one of the arm members by manually extending or retracting the other arm member.

9. A sawhorse as defined in claim 8, wherein each arm member of the workpiece support assembly has a smaller arm portion sized to be received within a hollow interior space of the top member and a larger end portion sized to prevent movement of the end portion of the associated arm member into the hollow interior space of said top member, each larger end portion having an upper workpiece support surface, the smaller arm portion of each arm member being movably mounted within the hollow interior space of the top member for movement between retracted and extended positions from a respective opposite end of the top member, the deployed workpiece support assembly being constructed and arranged such that (a) when the arm members are in their retracted positions, the support surfaces of the arm members are adjacent respective opposite ends of the elongated support surface of the top member and coplanar therewith to support a portion of a relatively narrow workpiece and (b) when the arm members are in their extended positions, the support surfaces of the arm members are spaced from the respective opposite ends of the elongated support surface of the top member and coplanar therewith to support a portion of a relatively wide workpiece.

10. A sawhorse as defined in claim 1, further comprising a spread limiting mechanism operatively connect to the base assembly for limiting an unfolding movement of the base assembly when the base assembly is moved into its open operative position, the spread limiting mechanism providing a support surface that functions as a shelf when the base assembly is in its open operative position.

11. A sawhorse as defined in claim 10, wherein the base assembly includes a pair of first and second base members, the base members being movably mounted to one another, the spread limiting mechanism including a first part and a second part connected through a central hinge, and wherein said spread limiting mechanism is hingedly connected at opposite ends to said first and second base members, respectively, so that the first part and second parts are folded at the central hinge when the base assembly is in its folded storage position and the first and second parts provide said support surface when the base assembly is in its open operative position.

12. A sawhorse as defined in claim 10, wherein the spread limiting mechanism comprises a shelf hingedly connected to the first base member, the shelf being constructed and arranged to move into hooking engagement with structure on the second base member to limit movement of the base members in the opening direction thereof.

13. A sawhorse as defined in claim 1, further comprising a power strip mounting assembly removably mounted on the base assembly to removably mount a power strip thereon.

14. A sawhorse as defined in claim 1, further comprising a cable holder removably mounted on the base assembly.

15. A sawhorse as defined in claim 1, wherein the base assembly includes a pair of first and second base members, the base members being movably mounted to one another and each base member having a pair of ground engaging legs, each ground engaging leg of the second base member having an open cross section defining an interior storage space constructed and arranged to receive in nested relation therein a respective leg of the first pair of legs of the first base member so that when the base assembly is folded, each leg of the first base member is housed within a respective leg of the second base member.

16. A sawhorse as defined in claim 15, wherein the workpiece support assembly includes a pair of elongated extension elements and wherein each leg of said first pair of legs is of hollow tubular construction defining a tubular end opening constructed and arranged to receive a respective one of the pair of extension elements for relative movement between the extensions elements and said openings to thereby provide said movement in said opposite directions between said workpiece support assembly and the base assembly as aforesaid and wherein each leg of the second pair of legs further includes locking structure that moves into a position of locking engagement with the extension elements in response to movement of the base assembly from the storage position thereof into the operative position thereof to lock the workpiece support assembly in the selected relative position thereof with respect to the base assembly as aforesaid.

17. A sawhorse as defined in claim 16, wherein each said extension element includes a plurality of teeth and wherein said locking structure comprises a pair of respective locking surface portions of the second pair of legs, each said surface portion of the second pair of legs being constructed and arranged to lockingly engage a selected one of said teeth of an associated extension element in response to movement of the base assembly from the storage position thereof into the operative position thereof.

* * * * *